US006343200B1

(12) United States Patent
Hatano et al.

(10) Patent No.: US 6,343,200 B1
(45) Date of Patent: Jan. 29, 2002

(54) DEVELOPING DEVICE HAVING CONVEYANCE MIXING UNITS

(75) Inventors: Masaru Hatano, Nara; Hiroaki Ohashi, Nagaokakyo; Hiroyoshi Omura, Suita; Hideki Ishida, Kawachinagano; Hiromi Yamaguchi, Higashiosaka, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/636,650

(22) Filed: Jul. 24, 2000

(30) Foreign Application Priority Data

Jul. 30, 1999 (JP) ..... 11-216466

(51) Int. Cl.[7] ..... G03G 15/08

(52) U.S. Cl. ..... 399/254; 399/119; 399/256; 399/263

(58) Field of Search ..... 222/167, DIG. 1; 399/119, 254, 255, 256, 258, 263, 260, 262, 272, 273, 274, 281, 283, 284; 430/120

(56) References Cited

U.S. PATENT DOCUMENTS 4,914,481 A * 4/1990 Yoshikai et al. ..... 399/256
5,020,471 A * 6/1991 Yoshikai ..... 399/256
5,355,199 A * 10/1994 Bray ..... 399/254

* cited by examiner

*Primary Examiner*—Sophia S. Chen
*Assistant Examiner*—Hoang Ngo
(74) *Attorney, Agent, or Firm*—Jordan & Hamburg LLP

(57) ABSTRACT

A developing device for use in an image forming apparatus includes a developing agent supply unit which supplies a developing agent to a photoreceptor, a first mixing unit provided near the developing agent supply unit to convey the developing agent in a first conveyance direction while mixing the developing agent, a second mixing unit provided underneath the first mixing unit to receive the developing agent at a downstream end along the first conveyance direction so as to supply the developing agent to the developing agent supply unit while mixing and conveying the developing agent in a second conveyance direction, and a developing agent scoop-up unit provided substantially in the middle in a height direction between the first mixing unit and the second mixing unit along the second conveyance direction to receive the developing agent from the second mixing unit and draw up the received developing agent to the first mixing unit.

18 Claims, 6 Drawing Sheets

DEVELOPING DEVICE HAVING CONVEYANCE MIXING UNITS

BACKGROUND OF THE INVENTION

1. Field of the Invention

This invention relates to a developing device for use in an image forming apparatus such as copier and printer to supply a developing agent to a photoreceptor so as to develop a latent image into a toner image, and more particularly to a developing device which uses a two-component developing agent consisting of toner and carrier.

2. Description of the Related Art

Heretofore, there has been known a developing device for use in an image forming apparatus to develop an electrostatic latent image formed on the surface of a photosensitive drum into a toner image with use of a two-component developing agent consisting of toner and carrier.

Such a developing device is provided with a housing for accommodating a developing agent, developing agent supplier means for supplying the developing agent in the housing to the surface of the photosensitive drum to develop a latent image into a toner image, developing agent mixing means for mixing the developing agent in the housing while at the same time feeding the developing agent in a certain direction, and toner replenishing means for replenishing toner into the housing.

The developing agent supplier means supplies toner on a certain area (developing area) of the drum surface to develop the latent image into a toner image within the area. As the toner in the housing is used up in accordance with progress of the image formation, the toner replenishing means replenishes toner into the housing. The developing agent mixing means agitates the developing agent, namely mixes the toner particles with the carriers which are electrically charged to convey the toner particles together with the charged carriers owing to electrostatic friction.

A known technology relating to agitation and transport of developing agent is disclosed in, for example, Japanese Unexamined Patent Publication No. 10-142942. The publication discloses a four-membered tandem type developing device for use in a color copier comprising: developing agent supplier means for supplying a developing agent onto the surface of a photosensitive drum; first mixing/transporting means disposed near the developing agent supplier means to agitate the developing agent while transporting the developing agent in a first direction thereof; second mixing/transporting means disposed underneath the first mixing/transporting means to agitate the developing agent while transporting the developing agent in a second direction opposite to the first direction; and feeder means coaxially provided along with the longitudinal direction of the developing agent supplier means to feed the developing agent transported by the second mixing/transporting means toward the first mixing/transporting means in response to driving of the developing agent supplier means.

The above-mentioned conventional developing device has room for improvement in the aspect of agitation and transport of developing agent, prevention of undesired stay of developing agent, and reducing the dimensions of the developing device itself. Particularly, as for the dimensions of the device itself, since the feeder means is provided coaxially with the developing agent supplier means (magnet roller) to feed the developing agent from the second mixing means (lower mixing means) to the first mixing means (upper mixing means), the device itself is inevitably large in the axial direction of the magnet roller by a dimension corresponding to the axial length of the feeder means which axially protrudes beyond the developing area.

SUMMARY OF THE INVENTION

In view of the above problems residing in the prior art, it is an object of the present invention to provide a developing device of a compact size particularly in the axial length thereof that enables to ensure sufficient agitation of a developing agent and prevention of undesired stay of the developing agent.

In one aspect of this invention, a developing device for use in an image forming apparatus comprises: a developing agent supply unit which supplies a developing agent to a photoreceptor; a first mixing unit provided near the developing agent supply unit to convey the developing agent in a first conveyance direction while mixing the developing agent; a second mixing unit provided underneath the first mixing unit to receive the developing agent from the first mixing unit at a downstream end along the first conveyance direction so as to supply the developing agent to the developing agent supply unit while mixing and conveying the developing agent in a second conveyance direction; and a developing agent scoop-up unit provided substantially in the middle in a height direction between the first mixing unit and the second mixing unit and at a downstream end of the second mixing unit along the second conveyance direction to receive the developing agent from the second mixing unit and draw up the received developing agent to the first mixing unit.

With this arrangement, the developing agent is sufficiently mixed while conveyed in the first and second conveyance directions by the first and second mixing units. Further, this arrangement enables to provide an image forming apparatus of a compact size, particularly in the axial direction of the developing device while preventing stagnation of the developing agent.

These and other objects, features and advantages of the present invention will become more apparent upon a reading of the following detailed description and accompanying drawings.

DETAILED DESCRIPTION OF THE PREFERRED EMBODIMENTS

Figure 1:
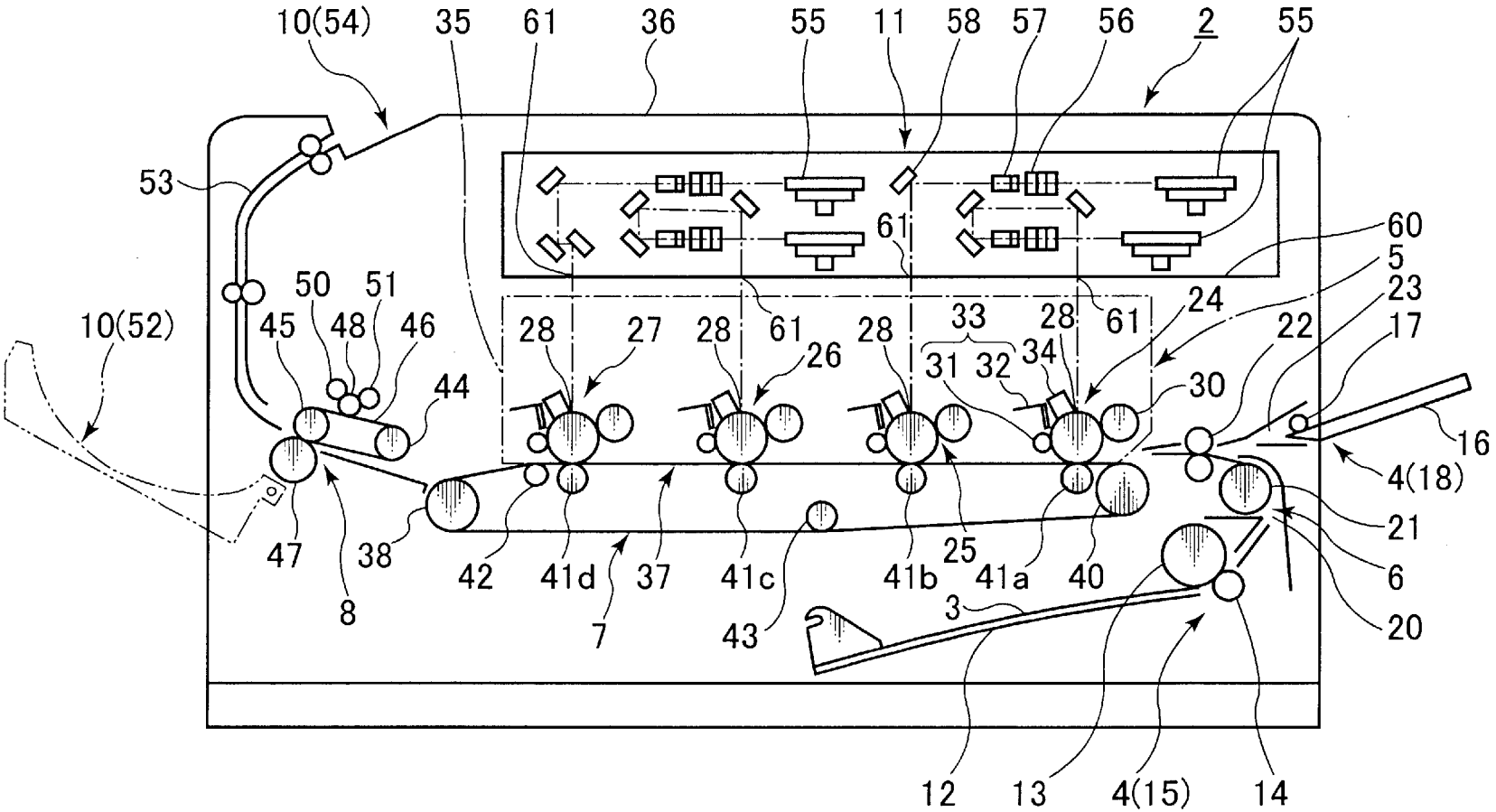
FIG. 1 is a schematic diagram showing an overall construction of an image forming apparatus incorporated with a developing device according to this invention.

FIG. 1 is a schematic diagram showing an overall construction of a color printer as an embodiment of an image forming apparatus according to this invention.

The construction of the color printer is described with reference to FIG. 1. The color printer 2 includes a sheet feeder section 4 for feeding a sheet member 3 on which an image is to be copied one by one, a sheet transport section 6 for transporting the sheet member 3 fed from the sheet feeder section 4 in a certain direction, an imaging assembly 5 for forming an toner image which is to be transferred onto the sheet member 3, an image transfer section 7 for transferring the toner image onto the sheet member 3, an image fixing section 8 for fixing the transferred toner image on the sheet member 3, a sheet discharge section 10 which receives the sheet member 3 after the image fixation, and an optical unit 11.

Specifically, the sheet feeder section 4 includes a first feeder unit 15 and a second feeder unit 18. The first feeder unit 15 is constructed in such a manner that sheet members 3 stacked on a first sheet tray 12 are fed one by one by a feed roller (drive roller) 13 and a retard roller (driven roller) 14 toward downstream of the sheet transport direction. The second feeder unit 18 is constructed in such a manner that sheet members 3 stacked on a manual insertion tray 16 are fed one by one by a feed roller 17 toward downstream of the sheet transport direction.

The sheet transport section 6 includes a transport path 20 along which the sheet member 3 is fed from the first sheet feeder unit 15 or the second sheet feeder unit 18 toward the imaging assembly 5, a transport roller 21 disposed at a certain position on the transport path 20, a registration roller pair 22 which temporarily suspends transport of the sheet member 3 as timed with nipping of the lead end of the sheet member 3 and resumes transport of the sheet 3 toward the imaging assembly 5 while correcting a skew transport of the sheet member 3, and a manual transport path 23 which is connected to the transport path 20 at an upstream position from the registration roller pair 22 with respect to the sheet transport direction.

The imaging assembly 5 includes a first imaging section 24 adapted to form a black color image, a second imaging section 25 adapted to form a cyan color image, a third imaging section 26 adapted to form a magenta color image, and a fourth imaging section 27 adapted to form a yellow color image. The first, second, third, and fourth imaging sections 24, 25, 26, 27 each is provided with a cylindrical photosensitive drum 28, a developing unit 30 for forming individual color toner image on the surface of the photosensitive drum 28, a cleaning unit 33 provided with a brush 31 for removing toner residues on the surface of the photosensitive drum 28 and a cleaning blade 32 for scraping off toner residues on the surface of the photosensitive drum 28, and a charger 34 which supplies electric charges on the photosensitive drum surface to uniformly charge the surface of the photosensitive drum 28.

The image transfer section 7 includes an endless belt 37 composed of a resin material containing fluorine compound, a drive roller 38 and a tension roller (driven roller) 40 for circulating the belt 37, and transfer rollers 41*a*, 41*b*, 41*c*, 41*d* respectively disposed at certain positions opposing the corresponding photosensitive drums 28. The image transfer section 7 is constructed in such a manner that the sheet member 3 is conveyed further downstream of the sheet transport direction over the endless belt 37 which is driven between the transfer roller 41*a* (41*b*, 41*c*, 41*d*) and the corresponding photosensitive drum 28. Guide rollers 42, 43 are provided at respective appropriate positions on an inner circumference of the transfer belt 37.

In the case where the image transfer section 7 is adapted to form a monochromatic image, the transfer roller 41*a* is driven while the other transfer rollers 41*b*, 41*c*, 41*d* being set apart from the surface of the corresponding photosensitive drums 28.

The image fixing section 8 includes a heater roller 44 built-in with a heater (not shown), a fixing roller 45, a metallic endless belt 46 which is wound around the heater roller 44 and the fixing roller 45, and a presser roller 47 which is pressed against the fixing roller 45. The image transfer section 7 further includes an oil supply roller 48 for applying silicone oil onto the outer surface of the endless belt 46, an oil replenish roller 50 for replenishing silicone oil to the oil supply roller 48, and a cleaning roller 51 for wiping off oil residue on the surface of the oil replenish roller 50.

The sheet discharge section 10 includes a first discharge unit 52 for receiving the sheet members 3 discharged from the fixing section 8 one by one to stack the sheet members 3 one over another with the surface thereof formed with an image facing upward, and a second discharge unit 54 for guiding the sheet members 3 discharged from the fixing section 8 one by one toward an upper part of a main body 36 of the image forming apparatus via a discharge path 53 to stack the sheet members 3 one over another with the surface thereof formed with an image facing downward. In the case where the first discharge unit 52 is not used, it is accommodated in the apparatus main body 36.

The optical unit 11 is constructed in such a manner that a set of a polygonal mirror 55, lenses 56, 57, and a mirror 58 is arranged at a certain position in correspondence with the corresponding photosensitive drum 28. A laser beam is irradiated onto the surfaces of the photosensitive drums 28 via slits 61 each of which is formed in an optical unit support plate 60 at a certain position corresponding to the photosensitive drum 28.

In the color printer 2 having the above construction, when a sheet member 3 is fed from the first feeder unit 15 or the second feeder unit 18, the sheet member 3 is guided first between the photosensitive drum 28 of the first imaging unit 24 and the transfer belt 37 via the sheet transport section 6. Wile the sheet member 3 is conveyed over the transfer belt 37 between the transfer rollers 41*a*, 41*b*, 41*c*, 41*d* and the corresponding photosensitive drums 28 in this order sequentially, toner images of respective colors (black, magenta, cyan, yellow) formed by the respective photosensitive drums 28 are sequentially transferred onto the sheet member 3.

When the sequential color image transfer is completed, the sheet member 3 is guided between the fixing roller 45 and the presser roller 47 while conveyed by the transfer belt 37 to thereby fix the color image. After the color image fixation, the sheet member 3 is discharged onto the first discharge unit 52 or the second discharge unit 54.

Next, the developing device for use in an image forming apparatus according to this invention is described in detail with reference to FIGS. 2 to 4.

Figure 2A:
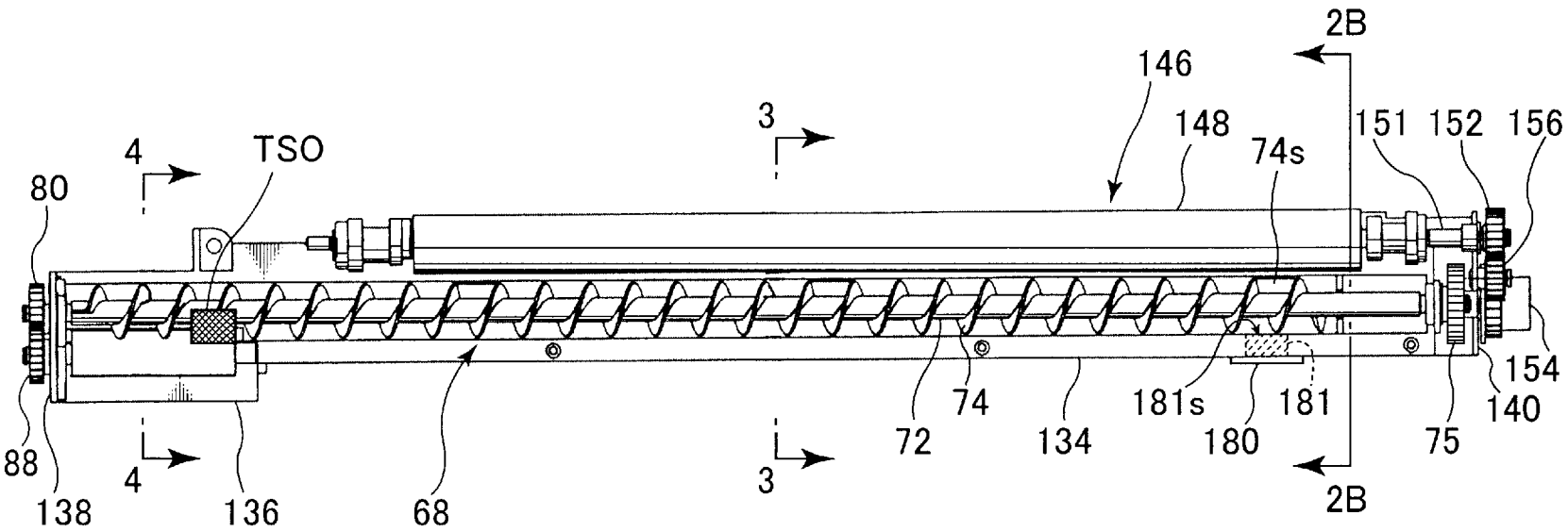
FIG. 2A is a diagram showing an internal mechanism of the developing device.
Figure 3:
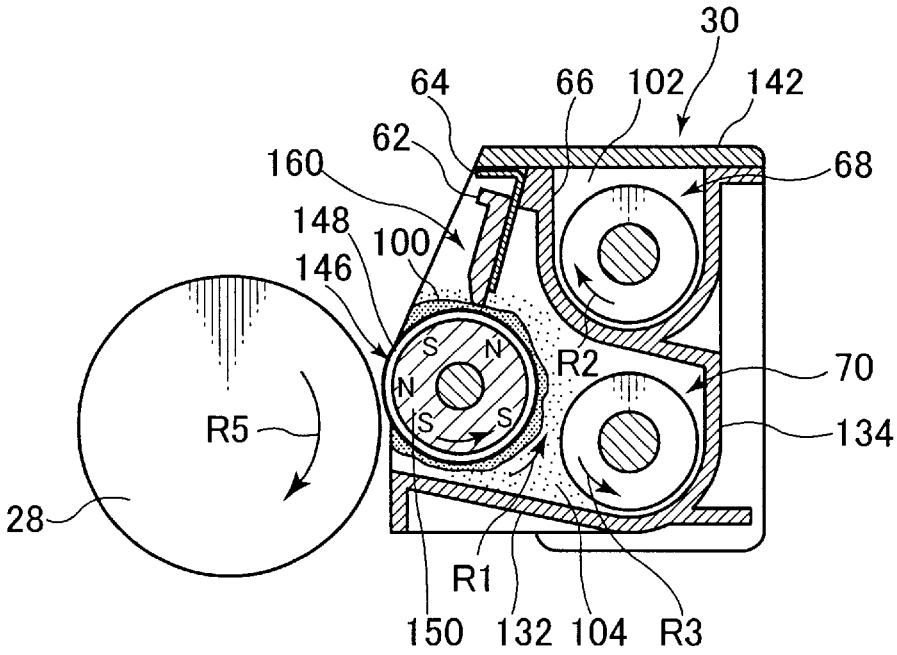
FIG. 3 is a cross-sectional view taken along the line 3—3 in FIG. 2A.
Figure 4:
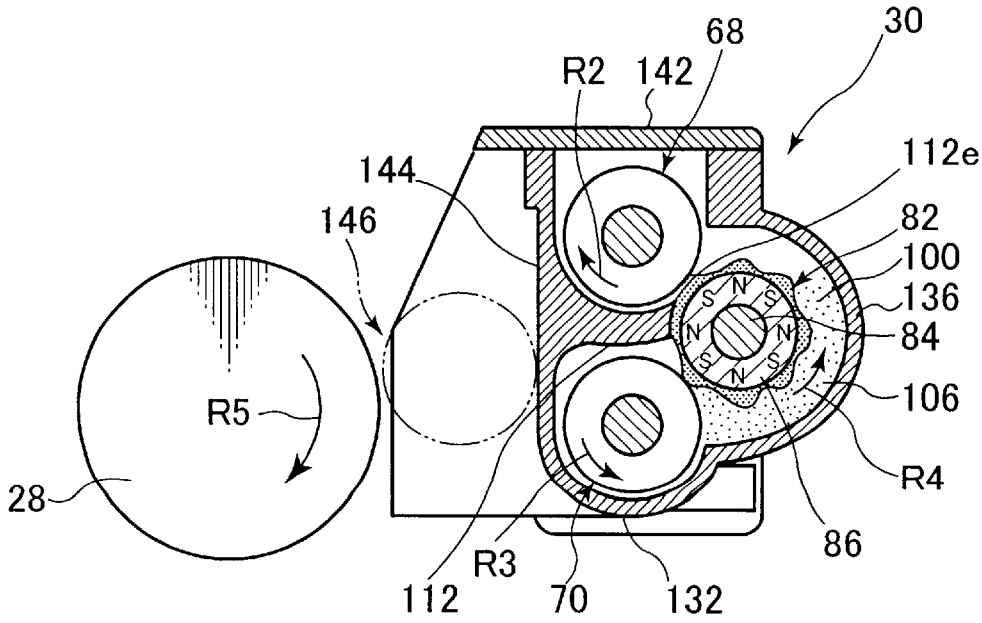
FIG. 4 is a cross-sectional view taken along the line 4–4 in FIG. 2A.

FIG. 2A is a diagram showing an internal mechanism of the developing unit 30 viewed from top of the apparatus main body 36, FIG. 3 is a cross-sectional view taken along the line 3—3 in FIG. 2A, and FIG. 4 is a cross-sectional view taken along the line 4—4 in FIG. 2A.

The developing unit 30 has a developing housing 144. The housing 144 is made of a synthetic resin material, and generally includes a bottom wall 132, a first side wall 134 generally extending upward perpendicularly from the bottom wall 132 over the entire length thereof (axial direction of the developing unit 30), a second side wall 136 formed on left side of the first side wall 134 in FIG. 2A, a front wall 138 formed at a left end of the first side wall 134 in FIG. 2A, a rear wall 140 formed at a right end of the first side wall 134 in FIG. 2A, and a top wall 142 formed at a top part of the housing 144 as shown in FIGS. 3 and 4. The second side wall 136 constitutes part of a developing agent scoop-up section of the developing unit 30 which is described below.

Figure 5:
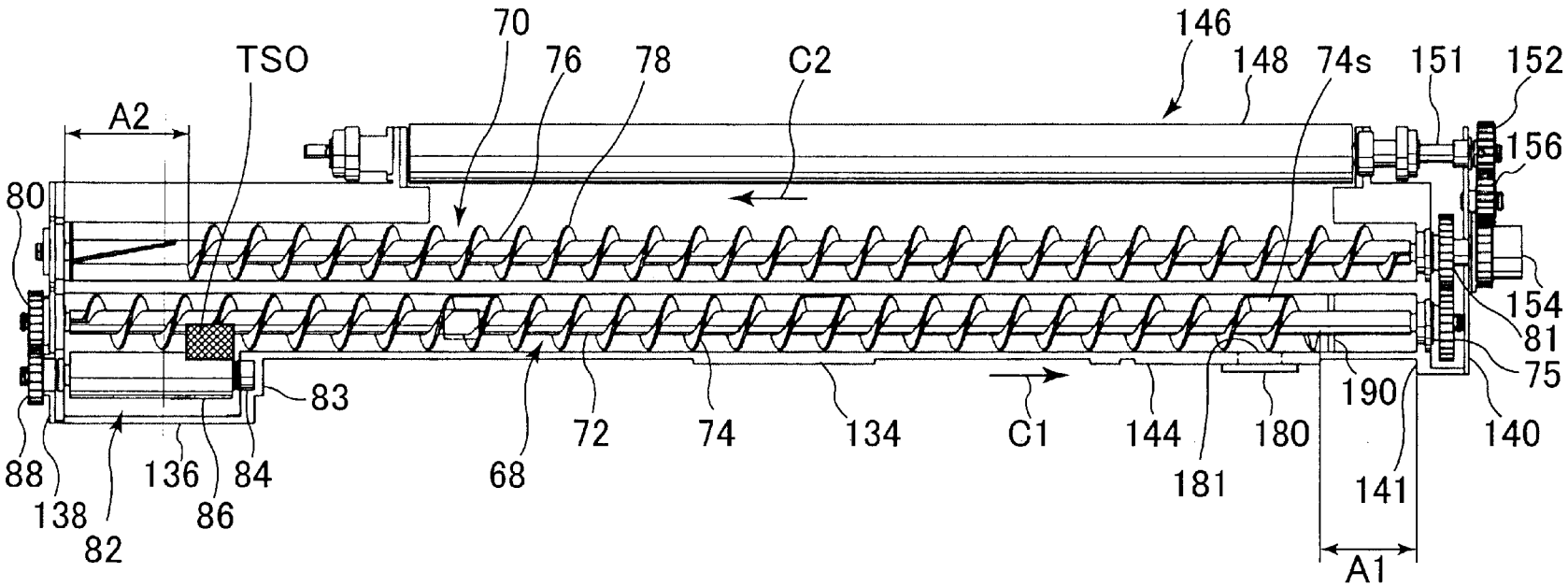
FIG. 5 is a schematic diagram showing essential elements of the developing device.

Note that the axial direction of the developing unit 30 corresponds to the depthwise direction of the apparatus main body 36, and the left side and the right side of the developing unit 30 in FIGS. 2A and 5 respectively correspond to front side and rear side of the apparatus main body 36. Further, left and right directions in FIG. 1 corresponds to widthwise directions of the apparatus main body 36.

As shown in FIG. 3, the housing 144 is provided with a developing agent supply unit 146 at a left end thereof. The developing agent supply unit 146 includes a cylindrical sleeve 148 composed of a non-magnetized material such as aluminum and extending axially to generally cover a developing area by the developing device for image formation, and an inner member 150 provided inside the developing sleeve 148 and composed of a magnetic material.

The sleeve 148 is rotatably connected to a driver system which is described below, and the inner member 150 is fixed to the sleeve 148. As shown in FIG. 2A, a rotary shaft 151 fixed to the developing sleeve 148 protrudes in depthwise directions of the apparatus main body 36 and passes through the rear wall 140. An input gear 152 is fixed to a protruding end of the rotary shaft 151. When a drive source (not shown) of the driver system is driven, a driving force thereof is transmitted to the input gear 152 by way of an output gear 154 and an idle gear 156, thereby rotating the rotary shaft 151 in a direction shown by the arrow R1 in FIG. 3. A developing agent 100 consisting of toner particles and carriers is conveyed on the outer surface of the developing sleeve 148 due to magnetic attraction of the carriers toward the magnetic member 150 provided inside the developing sleeve 148. The manner of conveying the developing agent 100 is described below in detail.

Hereinafter, specifications of toner and carrier as main components of a developing agent used in the present invention, but not limited thereto, are described.

(1) Carrier:
- Carrier medium grain size (diameter): 0.6 $\mu$m;
- Shape: Spherical;
- Material: Ferrite;
- Saturation Magnetization: 65 emu;

(2) Toner:
- Toner medium grain size: 8.5 $\mu$m;
- Resin composition: Polyester;
- Toner Density: fluctuates in a range of 4–5 wt % under normal condition and fluctuates in a range of 3.5 to 6 wt % under non-ordinary condition such as a shortage of toner or a change in environmental factor.

Note that the above specifications for the carrier and the toner are one of the examples, thus inducing no limitations to the application of the present invention.

As shown in FIG. 3, a developing agent scraper 160 is provided above the developing agent supply unit 146. The scraper 160 includes a blade 62 with a pointed edge portion at a lowermost part thereof and a holder 64 for holding the blade 62. The holder 64 is fixedly supported at a certain position on an upper front part of a partition wall 66 which is adapted to accommodate a first mixing unit 68. The edge portion of the blade 62 extends substantially over an entire axial length of the developing unit 30 at a slightly downstream position from an uppermost part of the developing sleeve 148 with respect to the rotating direction R1 of the developing sleeve 148.

The edge portion of the blade 62 is set generally in the middle between a magnetic field of north pole and a magnetic field of south pole at an upper part of the magnetic member 150 (see FIG. 3). Residue of the developing agent 100 which has deposited on the circumferential surface of the developing sleeve 148 is scraped off by the edge portion of the blade 62, subjected to agitation/mixing by a second mixing unit 70, and then reused for next image formation by magnetic attraction of the carriers of the developing agent 100 toward the surface of the developing sleeve 148 again.

Next, an operation of a developing agent mixing device of the developing unit 30 is described in detail with reference to FIG. 5. FIG. 5 is an expansion view showing a view of the developing unit 30 taken along a line extending through a center of the developing agent supply unit 146, a center of the second mixing unit 70, a center of the first mixing unit 68, and a center of a scoop-up unit. The first and second mixing units 68, 70 constitute the developing agent mixing device.

The first mixing unit 68 is constructed in such a manner that a rotary shaft 72 is rotatably mounted between the front wall 138 and an inner wall 141 formed on the inner side (left side in FIG. 5) of the rear wall 140. The rotary shaft 72 is formed with an impeller 74 generally over the axial length thereof except an area A1 at a downstream end with respect to a first conveyance direction of the developing agent 100 shown by the arrow C1 in FIG. 5. The rotary shaft 72 extends outwardly from the front wall 138 by a certain length, and a gear 80 is attached to the distal end thereof. A gear 75 is fixed to the rotary shaft 72 between the rear wall 140 and the inner wall 141.

The second mixing unit 70 is constructed in such a manner that a rotary shaft 76 is rotatably mounted between the front wall 138 and the rear wall 140. Similar to the rotary shaft 72, the rotary shaft 76 is formed with an impeller 78 generally over the axial length thereof except an area A2 at a downstream end with respect to a second conveyance direction of the developing agent 100 shown by the arrow C2 in FIG. 5. The output gear 154 is fixed to a right end of the rotary shaft 76, and a gear 81 is mounted to the rotary shaft 76 between the inner wall 141 and the rear wall 140. The gear 81 is interlocked with the gear 75.

Next, the developing agent scoop-up unit 82 is described in detail. As shown in FIG. 4, the developing agent scoop-up unit 82 is provided at a substantially middle position vertically between the first mixing unit 68 and the second mixing unit 70 on the right side of the first and second mixing units 68, 70.

Referring back to FIG. 5, the developing agent scoop-up unit 82 is provided on the front side (left side in FIG. 5) of the housing 144, namely, beyond the developing area of the developing sleeve 148 in the axial direction of the developing unit 30. The developing agent scoop-up unit 82 is constructed in such a manner that a rotary shaft 84 is rotatably mounted between the front wall 138 and a second rear wall 83. The rotary shaft 84 is fixedly mounted with a scoop-up roller 86 composed of a magnetic material generally over the axial length thereof. The rotary shaft 84 protrudes forward (leftward in FIG. 5) from the front wall 138, and a gear 88 is fixed at the protruding end. The gear 88 is interlocked with the gear 80. The scoop-up roller 86 is in the shape of a cylinder with a continued surface and made of a ferrite material. The scoop-up roller 86 is magnetized in such a manner that a magnetic field generates in eight equi-sectioned areas circumferentially with each field having a magnetic force of about 800 gauss and that north pole and south pole appear alternately in the eight fields.

Figure 8:
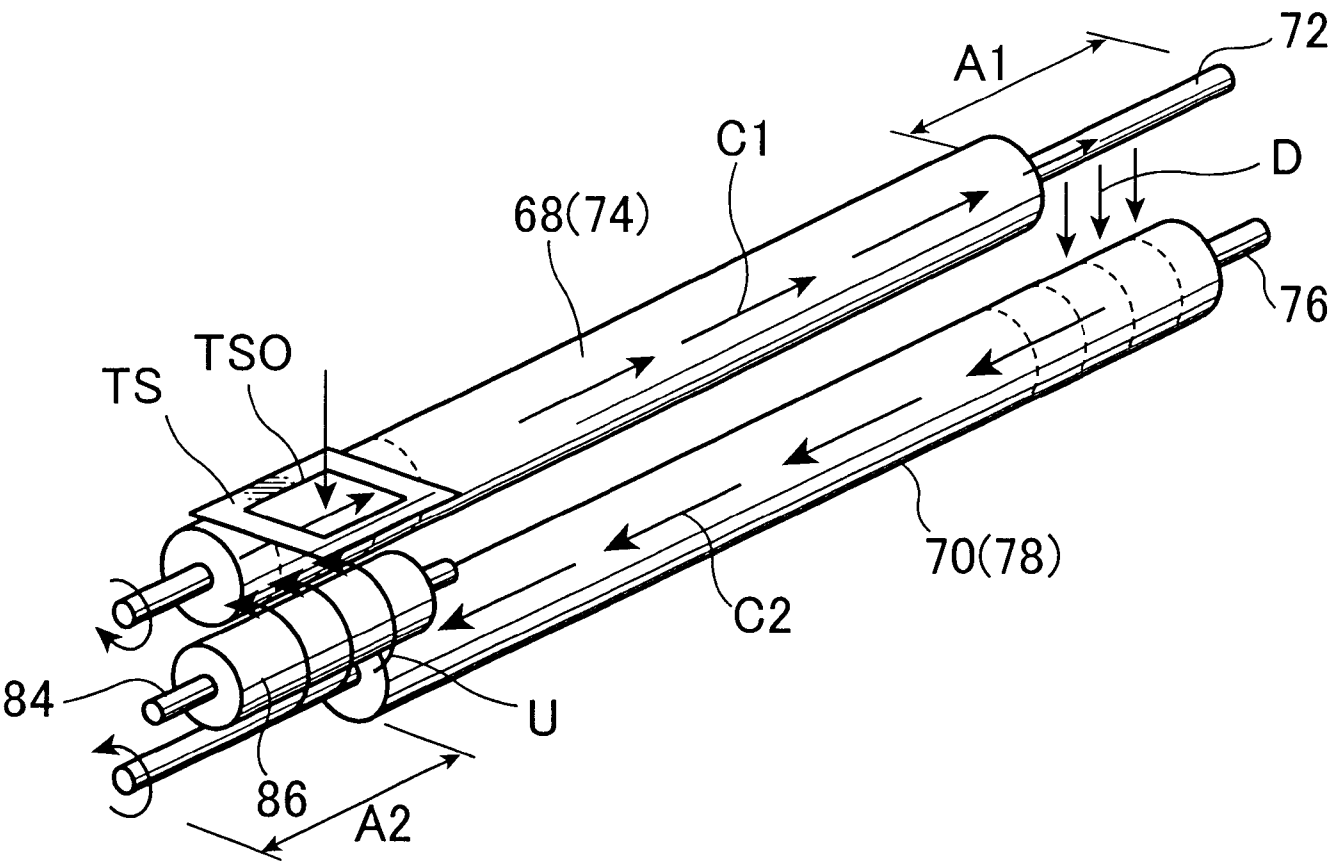
FIG. 8 is an explanatory diagram showing as to how a developing agent is delivered through the developing device.

As shown in FIGS. 2A, 5 and 8, a toner supply unit TS having a toner supply opening TSO is provided in an area vertically above the merging area between the first mixing unit 68 and the scoop-up roller 86 so that the toner can be directly supplied onto the merging area. More specifically, the toner supply opening TSO is preferably provided on a downstream side in the merging area along the developing agent delivering direction by the first mixing unit 68. By positioning the toner supply opening TSO as described in the above, the supplied toner from the toner supply opening TSO is subject to both a scoop-up force derived by the scoop-up roller 86 and a delivering (propelling) force derived by the first mixing unit 68 so that the supplied toner is well blended with the existing developing agent. Furthermore, there is a slight clearance between a lead end 112e of a separation wall 112 and an external surface of the scoop-up roller 87, thus the supplied toner from the toner supply opening TSO may not easily fall through the clearance. Note that the lead end 112*e* of the separation wall is also referred to as a scraping portion that scrapes off the excessive amount of the developing agent attracted to around the scoop-up roller 86.

Figure 6:
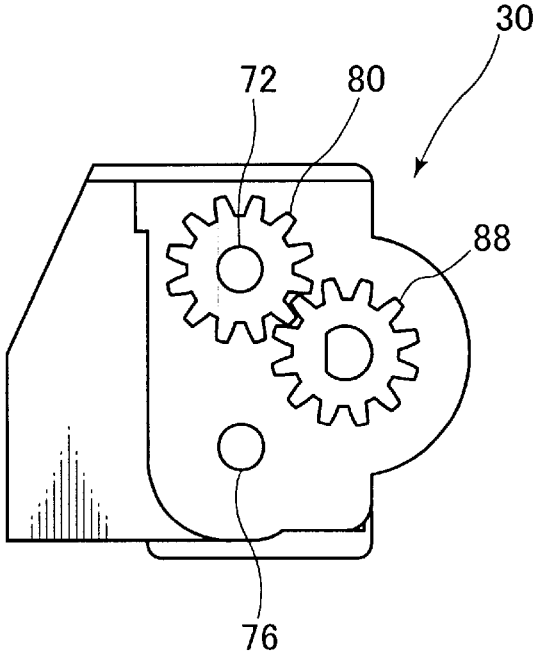
FIG. 6 is a diagram showing an interlocked state of gears viewed from rear side of the image forming apparatus.
Figure 7:
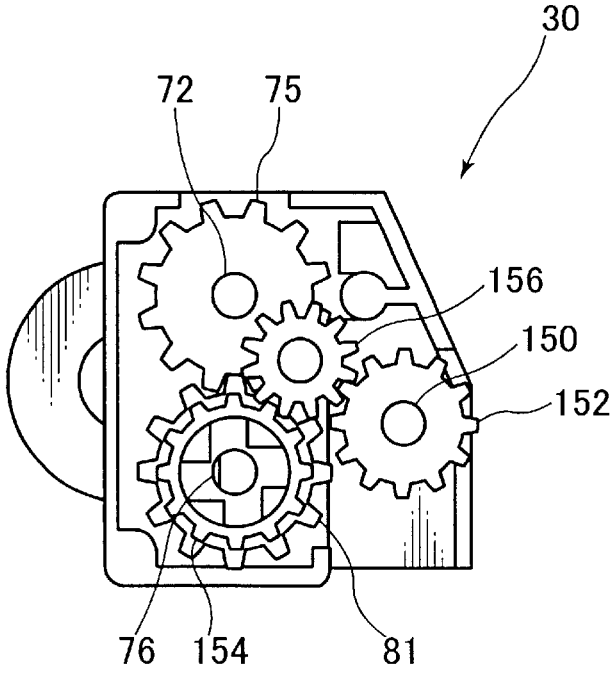
FIG. 7 is a diagram showing an interlocked state of gears viewed from front side of the image forming apparatus.

FIG. 6 is a diagram showing an interlocked state of the gears viewed from the rear side of the developing unit 30, and FIG. 7 is a diagram showing an interlocked state of the gears viewed from the front side of the developing unit 30. The developing unit 30 is described further with reference to FIGS. 6 and 7.

When a driving force of the drive source (not shown) is transmitted to the output gear 154, the driving force is transmitted to the gears 81, 75 via the rotary shaft 72. The driving force which has been transmitted to the gear 75 is then transmitted to the gears 80, 88 via the rotary shaft 72.

On the other hand, when the driving force of the drive source is transmitted to the output shaft 154, the driving force is also transmitted to the idle gear 156 and the input gear 152. Thus, as the driving force is transmitted to the gears, the first mixing unit 68 rotates in the direction shown by the arrow R2 in FIGS. 3 and 4, and the second mixing unit 70 rotates in the direction shown by the arrow R3 in FIGS. 3 and 4. The developing agent scoop-up unit 82 rotates in the direction shown by the arrow R4 in FIG. 4.

Referring back to FIG. 3, the developing agent 100 is stored in the developing housing 144. More specifically, the developing agent 100 is distributed in a first mixing section 102, a second mixing section 104, and a third mixing section 106 of the developing unit 30. The first mixing section 102 is defined by the partition wall 66 and the top wall 142 in which part of the first mixing unit 68 is accommodated. The second mixing section 104 is defined by a lower surface of the partition wall 66, the first side wall 134, and the bottom wall 132 in which the developing agent supply unit 146 and part of the second mixing unit 70 are accommodated. The third mixing section 106 is defined by the second side wall 136 (see FIG. 4), the bottom wall 132, and the top wall 142 in which part of the first mixing unit 68, part of the second mixing unit 70 and the scoop-up unit 82 are accommodated.

In the above construction where the developing agent 100 is distributed in each section, as the rotary shaft 72 of the first mixing unit 68 rotates in the direction of arrow R2, the developing agent 100 in the first mixing section 102 is conveyed along the axial direction of the rotary shaft 72, namely, in the first conveyance direction C1 shown in FIG. 5 while being mixed well homogeneously during its conveyance.

The developing agent 100 in the second mixing section 104 is conveyed in the second conveyance direction C2 as the rotary shaft 76 of the second mixing unit 70 rotates in the direction of arrow R3. The developing agent 100 is mixed well homogeneously during its conveyance. At this time, part of the developing agent 100 is supplied from the second mixing unit 70 to the developing agent supply unit 146, and then supplied to the developing area of the surface of the photosensitive drum 28 to develop a latent image into a toner image. The photosensitive drum 28 rotates in the direction of arrow R5 in FIGS. 3 and 4.

Next, with reference to FIGS. 5 and 8, how the developing agent 100 circulates while mixed and conveyed along the predetermined directions is described. First, the developing agent 100 in the first mixing section 102 is conveyed in the first conveyance direction C1, namely, from front to rear of the apparatus main body 36 by the operation of the first mixing unit 68. At this time, since the first mixing section 102 is not formed with the partition wall 66 at the area A1 and the impeller 74 is not formed on the first mixing unit 68 at the area A1, the developing agent 100 that has reached the area A1 is restrained from being conveyed further rearward in the first conveyance direction C1 and falls down from the first mixing section 102 into the second mixing section 104 by its weight at the area A1 (see an arrow D in FIG. 8).

Then, the developing agent 100 that has fallen off from the first mixing section 102 into the second mixing section 104 is conveyed in the second conveyance direction C2 in FIG. 5 and FIG. 8 by the operation of the second mixing unit 70 toward the area A2 at the left end in FIG. 5. Since the impeller 78 is not formed on the second mixing unit 70 at the area A2, there is no possibility that the developing agent 100 is conveyed further forward in the second conveyance direction C2. In addition, there is no possibility that the developing agent 100 stagnates on the area A2 and agglomerates thereat for the following reason.

When the developing agent 100 reaches the area A2, the scoop-up roller 86 of the developing agent scoop-up unit 82 magnetically attracts the developing agent 100 (carriers along with the toner particles) toward the circumferential surface thereof by its magnetic force and guides the developing agent 100 into the third mixing section (scoop-up section) 106 (see an arrow U in FIG. 8).

In the scoop-up section 106, the partition wall 112 (see FIG. 4) extends transversely from a side wall of the housing 144 in FIG. 4 at a vertically middle position between the first mixing unit 68 and the second mixing unit 70. The lead end 112*e* (or scraping portion) of the partition wall 112 is formed into an acute angular shape with a clearance of e.g., about 1.0 mm from the outer surface of the scoop-up roller 86.

The developing agent 100 magnetically attracted to the surface of the scoop-up roller 86 constitutes a magnetic heap as shown in FIG. 4. More specifically, the magnetic heap of the developing agent 100 deposits on the surface of the scoop-up roller 86 in such a manner that the deposited developing agent 100 forms a sharp peak corresponding to a high-magnetized region of the magnetic field of N- or S-pole and forms a moderate recess corresponding to a low-magnetized region defined circumferentially in the middle between the magnetic fields of N- and S- poles.

More specifically, the scoop-up roller 86 has the following specifications.

The length of the scoop-up roller 86 can be set in a range of 15 mm to 50 mm and is preferably set in a range of 20 mm to 35 mm, which is more than a pitch of a blade of an impeller 78 for the second mixing unit 70. Setting the length longer than the upper limit of the specified range will cause an unnecessary enlargement of the apparatus as a whole whereas lowering the length beyond the lower limit of the specified range will result in an insufficient scoop-up force derived by the scoop-up roller 86. The peripheral speed of the scoop-up roller 86 can be set in a range of 100 to 250 mm/min and is preferably set in a range of 150 to 200 mm/min. Raising the peripheral speed beyond the upper limit of the specified range will rapidly scrape off the developing agent around the scoop-up roller 86 by the lead end 112*e* of the partition wall, causing the developing agent to deteriorate more easily. On the other hand, lowering the peripheral speed beyond the lower limit of the specified range will result in an insufficient scoop-up capability derived by the scoop-up roller 86. Furthermore, the magnetic force for the scoop-up roller 86 is set in a range of 500 to 1200 Gauss. Exceeding the upper limit of the specified range may increase the possibility to deteriorate the developing agent whereas lowering beyond the lower limit of the specified range will result in an insufficient scoop-up capability of the scoop-up roller 86. The clearance between the circumference of the scoop-up roller 86 and the lead end (scraping portion) 112*e* of the separation wall 112 is set to be in a range of 0.3 mm–3 mm, and preferably in a range of 0.5 mm to 2 mm. Having the clearance larger than the upper limit of the specified range will cause an insufficient supply of the developing agent to the first mixing unit 68. On the other hand, the clearance smaller than the lower limit of the specified range will increase the chance of deteriorating the developing agent.

In this embodiment, since the magnetic field generates in such a state that the field of N-pole and the field of S-pole generate alternately in the circumferential direction of the scoop-up roller 86, a field having a magnetic force of 0 gauss does not exist in the scoop-up roller 86. Therefore, the scoop-up force (conveyance force) of the developing agent 100 by the scoop-up unit 82 can be varied according to needs.

As the scoop-up roller 86 rotates in the direction of arrow R4, the magnetic heap of the developing agent 100 deposited in the aforementioned manner on the surface of the scoop-up roller 86 is scraped off therefrom by the lead end 112*e* of the separation wall 112. The thus collected developing agent 100 is conveyed to the first mixing section 102 while carried over the transversely extending upper surface of the separation wall 112. When the developing agent 100 reaches the first mixing section 102, the developing agent 100 is conveyed in the first conveyance direction C1 by the rotation of the rotary shaft 72 of the first mixing unit 68 while mixed well. In this way, the developing agent 100 circulates while conveyed back and forth in the axial direction of the developing unit 30 in such a manner that the developing agent 100 is homogeneously mixed during the back and forth conveyance.

The developing agent mixing device is described in detail. The developing agent conveyance forces of the impeller 74 of the first mixing unit 68 and that of the impeller 78 of the second mixing unit 70 are set generally at the same level. Parameters to adjust the conveyance force include sizes of the impellers 74, 78, and shape thereof (twisting direction), spiral pitch thereof, and rotational speed, which enables to set the conveyance forces of the first and second mixing units 68, 70 in a desired relation. As one example for the present invention, an external diameter of the impeller of the second mixing unit 70 is set smaller than that of the first mixing unit 68. On the other hand, the rotational speed of the second mixing unit 70 is set greater than that of the first mixing unit 68. As a result, the conveyance capability (amount of developing agent per a given time) of the developing agent by the second mixing unit 68 is set substantially equal to that by the first mixing unit 68. Note that in this embodiment, a diameter of a shaft on which impeller wings are mounted for the first mixing unit 68 and that for the second mixing unit 70 are substantially the same so that when the external diameter of the impeller is greater than the other, the radial length of the impeller is longer than that of the other. With this feature, the developing agent supply unit 146 can be positioned further rightward direction (in FIG. 3). As a result, the width (a left to right dimension in FIG. 3) of the developing device as a whole can be made smaller, thereby enabling to make a space between the imaging sections 24, 25, 26, 27 small as well, which eventually contributes downsizing the printer 2 as a whole.

Figure 2B:
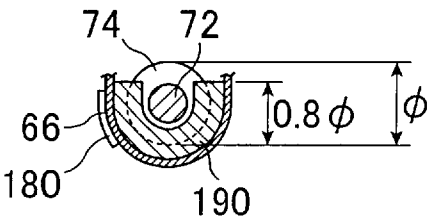
FIG. 2B is a cross-sectional view taken along the line 2B—2B in FIG. 2A.

Furthermore, as shown in FIGS. 2A, 2B, and 5, a separation plate 190 having a U-shape cross section is provided in the downstream portion of the first mixing unit 68. More specifically, the separation plate 190 is provided on the downstream side of the impeller 74 at the most downstream side along the first mixing unit 68 so that the developing agent accumulates in an area immediately upstream side of the separation plate 190. With this construction, the developing agent accumulates beyond the amount held by the separation plate 190 overflows from the separation plate 190. Accordingly, the overflowed developing agent from the separation plate 190 is supplied to the second mixing unit 70.

The upper edge of the separation plate 190 is so set as to come to a position as high as approximately eighty percent (0.8ϕ) of the diameter (ϕ) of the impeller 74 as shown in FIG. 2B.

In addition, the conveyance capability (amount of developing agent per a given time) derived by the scoop-up roller 86 is set larger than that by the impeller 74 of the first mixing unit 68 and that by the impeller 78 of the second mixing unit 70. Specifically, the conveyance capability of the developing agent by the scoop-up roller 86 is set in a range of 1.0 to 1.5 times of the conveyance capability by the second mixing unit 70.

More specifically, the conveyance force of the first and second mixing units 68, 70 is set at 1,120 g/min, and that of the developing agent scoop-up unit 82 is set at 1,350 g/min. Note that the present invention is not necessarily limited to the specified numerals.

When the image forming apparatus stops its operation, the developing agent tends to accumulate in downstream portion of the second mixing unit 70 and if the usual amount of the developing agent is delivered upon resuming the operation when the accumulated agent was not yet removed, it may adversely affect the conveyance performance of the developing agent. However, since the conveyance capability by the scoop-up roller 86 in the present invention is set greater than that by the second mixing unit 70, the agent accumulation in the downstream area of the second mixing unit 70 is scooped up to the first mixing unit 68 faster than the developing agent being transferred from the upstream side of second mixing unit 70. As a result, with the above described arrangement, the likely occurring problem, i.e., excessive accumulation of the agent in the downstream side of the second mixing unit 70, will be prevented. Furthermore, the amount of the developing agent delivered from the downstream side of the first mixing unit 68 to the upstream side of the second mixing unit 70 may fluctuate because of the presence of the separation plate 190. However, even if it fluctuates, conveyance of the developing agent throughout the entire passage will be well balanced because of the greater conveyance ability given to the scoop-up roller 86 than the second mixing unit 70. Moreover, the greater conveyance ability of the scoop-up roller 86 functions as a buffer to cope with the changes in conveyance capability of the each component of the developing agent due to the variation of the toner density or other environmental factors such as temperature and humidity. With this arrangement, when the developing agent 100 reaches the downstream end with respect to the second conveyance direction C2, namely, the area A2 in FIG. 5 after conveyed in the second conveyance direction C2 by the second mixing unit 70 while being homogeneously mixed in the second mixing section 104, the scoop-up roller 86 magnetically draws up the developing agent 100 that has reached the area A2 of the second mixing unit 70 into the third mixing section 106 by the operation of the scoop-up unit 82. Then, the developing agent 100 is securely and speedily supplied to the leftmost end of the first mixing unit 68 (see FIG. 5) located above the area A2 of the second mixing unit 70 after carried over the upper surface of the separation wall 112. With this arrangement, there can be prevented stagnation and agglomeration of the developing agent 100 in the developing unit 30 because the developing agent 100 is conveyed in a well-mixed manner in the predetermined directions back and forth, and a desirable image formation is carried out.

Referring back to the arrangement of the housing 144, a toner density detector (not shown) is provided at an appropriate position inside the housing 144 to detect the toner density of the developing agent 100. The toner density detector detects the toner density by sensing permeability of the developing agent 100.

Further, the toner supply unit TS is provided in the housing 144 which is operable in response to a detection output from the toner density detector 180. The toner supply unit TS automatically replenishes toner particles when the output of the toner density detector 180 falls below a predetermined level and suspends the replenishment when the output reaches the predetermined level. With this arrangement, the toner density in the housing 144 can be maintained in a certain range to develop a latent image into a toner image at a desirable toner density.

As an embodiment of this invention, but not limited thereto, the toner density detector 180 is provided near the separation plate 190 on its upstream side as shown in FIG. 2A. More specifically speaking, the toner density detector 180 has a sensing portion 181, generally a cylindrical form, which is provided at substantially the same level as the center axis of the first rotary shaft 72 and immediately upstream of the separation plate 190 such that the sensing portion can be maintained in contact with the accumulated developing agent in the downstream area of the first mixing unit 68. Furthermore, the sensing portion 181 has a sensing surface 181*s* which is cleaned up by a horizontally extended edge 74*s* of the impeller 74 as it rotates over the sensing surface 181*s*. As a result, the sensor 181 does not usually surface over the accumulated developing agent so that the sensor 181 does not likely sense the density of something other than the developing agent, thereby improving an accuracy in measurement. Furthermore, the place immediately upstream side of the separation plate 190 is where the developing agent has been well-mixed. Thus the sensor 181 can detect the toner density accurately.

As mentioned above, in one aspect of this invention, the developing device is constructed in such a manner that the developing agent is conveyed from upstream to downstream with respect to the first conveyance direction while being agitated by the first mixing unit and reaches the downstream end. Then, the developing agent is conveyed from upstream to downstream with respect to the second conveyance direction while being agitated by the second mixing unit. When the developing agent reaches the downstream end with respect to the second conveyance direction, the developing agent scoop-up unit magnetically draws up the developing agent to carry the developing agent up to the first mixing unit. In this way, the developing agent can be sufficiently mixed/agitated by the first and second mixing units aided by a speedy draw-up operation of the scoop-up unit.

This invention is advantageous in preventing stagnation of the developing agent in the downstream end with respect to the first and second conveyance directions. Therefore, an agglomeration-free developing device is provided to ensure a clear image formation supplied with well-mixed and sufficiently-charged toner particles.

Further, in another aspect of this invention, the developing device is constructed in such a manner that the first and second mixing units are vertically stacked one over the other with the second mixing unit located below the first mixing unit, and the developing agent scoop-up unit is provided with its axial direction aligned with the axial direction of the first and second mixing units at a substantially middle position vertically between the first and second mixing units. Furthermore, the rotary member (scoop-up roller) of the developing agent scoop-up unit is magnetized to magnetically draw up the developing agent. With this arrangement, scoop-up unit can be made smaller and the axial length of the developing device itself can be shortened, thereby enabling to provide a developing device and image forming apparatus of a compact size.

An embodiment of the developing device for use in an image forming apparatus according to this invention has been described in the above section. The developing device is not limited to the above embodiment, and the following modifications and alterations are applicable.

(1) In the embodiment, the developing agent scoop-up unit 82 is provided on right side of the first and second mixing units 68, 70 on the plane of FIG. 4. Alternatively, the scoop-up unit 82 may be provided on left side of the first and second mixing units 68, 70. In the altered arrangement, the scoop-up unit 82 can be installed in a space axially extending from the developing sleeve 148 where the developing sleeve 148 is not provided. Thereby, the transverse length (left and right directions in FIG. 4) of the developing unit 30 can be reduced. This altered arrangement makes it possible to shorten the overall width of the apparatus main body 36 even if the developing device is utilized in an image forming apparatus provided with a four-membered tandem type developing device as a color printer.

(2) In the embodiment, a sleeve is not provided on the scoop-up roller 84 of the developing agent scoop-up unit 82, which reduces the transverse size of the developing unit 30 (namely, the width of the apparatus main body 36). A sleeve may be mounted on the scoop-up roller 84 since mounting of the sleeve does not substantially influence the overall width of the apparatus main body 36.

(3) In the embodiment, the photosensitive drum 28 is used as a photoreceptor. A photosensitive belt may be used as a photoreceptor.

This application is based on patent application No. 11-216466 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device for applying a developing agent to a photoreceptor in an image forming apparatus comprising:

a developing agent supply unit which supplies the developing agent to the photoreceptor;

a first mixing unit to convey the developing agent in a first conveyance direction along a first axis of the first mixing unit to a downstream end thereof while mixing the developing agent;

a second mixing unit provided underneath the first mixing unit to receive the developing agent from the first downstream end of the first mixing unit and to convey the developing agent in a second conveyance direction, opposite to said first conveyance direction, along a second axis of the second mixing unit to a downstream end thereof while mixing the developing agent and delivering the developing agent to the photoreceptor;

a developing agent scoop-up unit provided substantially in the middle in a height direction between the first mixing unit and the second mixing unit and at said downstream end of the second mixing unit to receive the developing agent from the second mixing unit and draw up the received developing agent to the first mixing unit; and said developing agent scoop-up unit including a rotary member, and an even number of magnetic fields having a certain magnetic pole and formed in a circumferential direction of the rotary member.

2. The developing device according to claim 1, wherein said rotary member is formed with the magnetic fields generated by alternating north poles and south poles so as to have alternating directions.

3. The developing device according to claim 2, wherein the number of magnetic fields is any one of the numbers 4, 6, 8, 10, and 12.

4. The developing device according to claim 3, wherein said magnetic fields have substantially the same magnetic force.

5. The developing device according to claim 1, wherein a developing agent conveyance force of said developing agent scoop-up unit is set equal to or greater than the developing agent conveyance force of said first mixing unit and said second mixing unit.

6. The developing device according to claim 5, wherein a conveyance capability of the developing agent per a given time by the developing agent scoop-up unit is in a range of 1.0 to 1.5 times of that by the second mixing unit.

7. The developing device according to claim 1, wherein a conveyance capability of the developing agent per a given time by the developing agent scoop-up unit is in a range of 1.0 to 1.5 times of that by the second mixing unit.

8. The developing device according to claim 1, further comprising a toner supply unit having a toner supply opening which is positioned in a merging area between the first mixing unit and the developing agent scoop-up unit in a top view.

9. The developing device according to claim 8, wherein the toner supply opening is on the downstream side in the merging area along the first conveyance direction of the first mixing unit.

10. A developing device for applying a developing agent to a photoreceptor in an image forming apparatus comprising:

a developing agent supply unit which supplies the developing agent to the photoreceptor;

a first mixing unit to convey the developing agent in a first conveyance direction along a first axis of the first mixing unit to a downstream end thereof while mixing the developing agent;

a second mixing unit provided underneath the first mixing unit to receive the developing agent from the first downstream end of the first mixing unit and to convey the developing agent in a second conveyance direction, opposite to said first conveyance direction, along a second axis of the second mixing unit to a downstream end thereof while mixing the developing agent and delivering the developing agent to the photoreceptor; and a developing agent scoop-up unit provided substantially in the middle in a height direction between the first mixing unit and the second mixing unit and at said downstream end of the second mixing unit to receive the developing agent from the second mixing unit and draw up the received developing agent to the first mixing unit.

11. A developing device for applying a developing agent to a photoreceptor in an image forming apparatus, the developing device comprising:

a developing agent supply unit which supplies the developing agent to the photoreceptor;

a first mixing unit for conveying the developing agent in a first conveyance direction along a first axis of the first mixing unit to a downstream end thereof while mixing the developing agent;

a second mixing unit receiving the developing agent from the first downstream end of the first mixing unit and conveying the developing agent in a second conveyance direction, opposite to said first conveyance direction, along a second axis of the second mixing unit to a downstream end thereof while mixing the developing agent and delivering the developing agent to the photoreceptor; and a developing agent transfer device disposed adjacent the first mixing unit and the second mixing unit and at said downstream end of the second mixing unit to receive the developing agent from the second mixing unit and transfer the received developing agent to the first mixing unit.

12. The developing device of claim 11 wherein said first mixing unit includes a trough containing the developing agent and an agitator for effecting conveyance of the developing agent in the first conveyance direction along said trough.

13. The developing device of claim 12 wherein said agitator is helical.

14. The developing device of claim 11 wherein said developing agent transfer device is localized at said downstream end of the second mixing unit and transfers the received developing agent to said upstream end of the first mixing unit.

15. The developing device of claim 11 wherein said second mixing unit includes a trough containing the developing agent and an agitator for effecting conveyance of the developing agent in the second conveyance direction along said trough and said agitator extends adjacent to and along a length of said developing agent supply unit for delivering the developing agent to the developing agent supply unit.

16. The developing device of claim 15 wherein said agitator is helical.

17. The developing device of claim 11 wherein:

said first mixing unit includes a first trough containing the developing agent and a first agitator for effecting conveyance of the developing agent in the first conveyance direction along said first trough; and said second mixing unit includes a second trough containing the developing agent and a second agitator for effecting conveyance of the developing agent in the second conveyance direction along said second trough and said second agitator extends adjacent to and along a length of said developing agent supply unit for delivering the developing agent to the developing agent supply unit.

18. The developing device of claim 17 wherein said first and second agitators are helical.

* * * * *